US006719067B2

(12) United States Patent
Taga

(10) Patent No.: US 6,719,067 B2
(45) Date of Patent: Apr. 13, 2004

(54) INSERT FOR A PLASTIC POWER TOOL HOUSING

(75) Inventor: Koji Taga, Ohi-Machi (JP)

(73) Assignee: Taga Corporation, Musashino (JP)

( * ) Notice: Subject to any disclaimer, the term of this patent is extended or adjusted under 35 U.S.C. 154(b) by 0 days.

(21) Appl. No.: 10/033,450

(22) Filed: Dec. 27, 2001

(65) Prior Publication Data

US 2003/0121679 A1 Jul. 3, 2003

(51) Int. Cl.[7] ..... B25D 15/00
(52) U.S. Cl. ..... 173/93.5; 173/162.2
(58) Field of Search ..... 173/93, 93.5, 93.6, 173/162.1, 164, 210, 162.2

(56) References Cited

U.S. PATENT DOCUMENTS 3,561,543 A 2/1971 Ulbing
3,661,217 A 5/1972 Maurer
4,194,581 A * 3/1980 Walter ..... 175/92
4,582,146 A * 4/1986 Becker ..... 173/149
4,771,833 A * 9/1988 Honsa ..... 173/162.2
5,012,878 A * 5/1991 Anderson ..... 175/162
5,027,910 A * 7/1991 Honsa et al. ..... 173/162.2
5,054,562 A * 10/1991 Honsa et al. ..... 173/210
5,697,456 A * 12/1997 Radle et al. ..... 173/162.2
5,906,244 A 5/1999 Thompson et al.
6,123,158 A * 9/2000 Steffen ..... 173/217

* cited by examiner

*Primary Examiner*—Scott A. Smith
*Assistant Examiner*—Nathaniel Chukwurah
(74) *Attorney, Agent, or Firm*—Greer, Burns & Crain, Ltd.

(57) ABSTRACT

A rigid preformed insert is molded into a plastic housing for a power tool. The power tool further comprises a motor having a shaft, the motor being at least partly supported by the insert, and an impact clutch attached to the insert and operatively coupled to the motor shaft. The motor and clutch have a common axis, with the preformed insert located between the motor and the clutch. The insert fixedly secures the axis of the output shaft of the motor. The insert also forms a seal between the motor and clutch. The insert will not warp, distort or otherwise lose tolerance as a result of the molding process for the plastic housing. Further, because the insert is preformed of metal, is precisely orientated within the housing mold, and is permanently molded into the housing, it accurately defines the motor-clutch axis minimizing misalignment of the motor shaft.

20 Claims, 3 Drawing Sheets

INSERT FOR A PLASTIC POWER TOOL HOUSING

FIELD OF THE INVENTION

The present invention relates to power tools such as impact wrenches, and more particularly to plastic housings for power tools.

BACKGROUND OF THE INVENTION

Pneumatic tools, such as impact wrenches, are well known in the prior art. An impact wrench, for example, includes an air driven motor having an air inlet port and an air exhaust that vents to the atmosphere. High pressure air drives the motor as the air moves from a high pressure inlet, through the motor and is exhausted to atmosphere. An impact clutch assembly is coupled to an output shaft of the air motor. These tools are commonly used in an industrial setting, where a source of pressurized air may be used to power a number of individual units. Impact wrenches are particularly useful, because a number of different bits, sockets or attachments may be used to perform a variety of tasks.

Impact wrenches conventionally comprise a housing having a handle, an air motor housed in an upper portion of the housing, and an impact clutch assembly mounted to the front of the housing and operatively connected to the air motor. Impact wrench housings have traditionally been cast metal, such as aluminum. It is necessary that the housing be rigid to support the air motor and impact clutch, and withstand significant vibrations and other forces generated in the operation of the tool. It is also necessary that the housing accurately define the centerline of the air motor and impact clutch assembly. The air motor includes a longitudinal rotor shaft that meshes with and drives the impact clutch assembly. For proper operation of the tool, the air motor shaft must be accurately aligned with the impact clutch.

It would be desirable to reduce the weight and manufacturing costs of impact wrenches by molding the housing from plastic materials. However, prior efforts with plastic housings have met with limited success. One problem is that it is difficult to tightly control tolerances with molded plastic parts. Plastic parts can become distorted in the molding process, particularly after the part is removed from the mold and cooled. Second, plastic housings even when accurately molded, can become distorted during use, particularly when subjected to heat and severe vibratory and mechanical forces experienced during normal operation of impact wrenches or other pneumatically powered tools.

If the housing becomes distorted either in molding or in operation of the tool, it can cause misalignment between the air motor shaft and impact clutch assembly. If the motor and clutch are out of alignment excessive loads will be placed on the motor and/or clutch assemblies, resulting in undesirable wear, and in extreme cases, fatigue and failure. Furthermore, misalignment of the motor shaft often causes air leakage, which reduces the power and efficiency of the tool.

It would therefore be desirable to have a light weight plastic housing that will maintain accurate alignment of a motor and clutch assembly in a power tool.

SUMMARY OF THE INVENTION

These and other objects are met or exceeded by the present invention, which features a rigid preformed insert for a molded plastic housing for a power tool. The power tool comprises a housing molded substantially of plastic, a preformed insert molded into the housing, and a motor having a shaft, the motor being at least partly supported by the insert. The motor is preferably an air motor. The power tool further comprises an impact clutch attached to the housing and operatively coupled to the motor shaft. The motor and clutch have a common axis, with the preformed insert located between the motor and the clutch. The insert fixedly secures the axis of the output shaft of the motor. The insert also forms a seal between the motor and clutch.

The housing is molded plastic, preferably a fiberglass and nylon composite. The insert may be preformed to close tolerances from a dimensionally stable material. Most preferably, the insert is machined aluminum. The housing is manufactured by first forming and machining the insert, positioning the insert in a housing mold to define the motor axis, injecting the housing mold with plastic to form the housing and permanently secure the insert therein, and installing the output end of the motor into the back of the insert. An impact clutch assembly is then fastened to the housing, installed in the front of the insert, and operatively coupled to the motor shaft.

The insert of the invention solves the problems experienced with prior art plastic housings. Because the insert is preformed, for example by machining the insert from metal, the insert will not warp, distort or otherwise lose tolerance as a result of the molding process for the plastic housing. Further, because the insert is preformed of rigid, dimensionally stable material, is precisely orientated within the housing mold, and is permanently molded into the housing, it accurately defines the motor-clutch axis minimizing if not preventing misalignment of the motor shaft. Excessive wear and air leakage are avoided.

The objects of the invention have accordingly been met in a facile manner. Other attributes and benefits of the present invention will become apparent from the following detailed specification when read in conjunction with the accompanying drawings.

DETAILED DESCRIPTION

Figure 1:
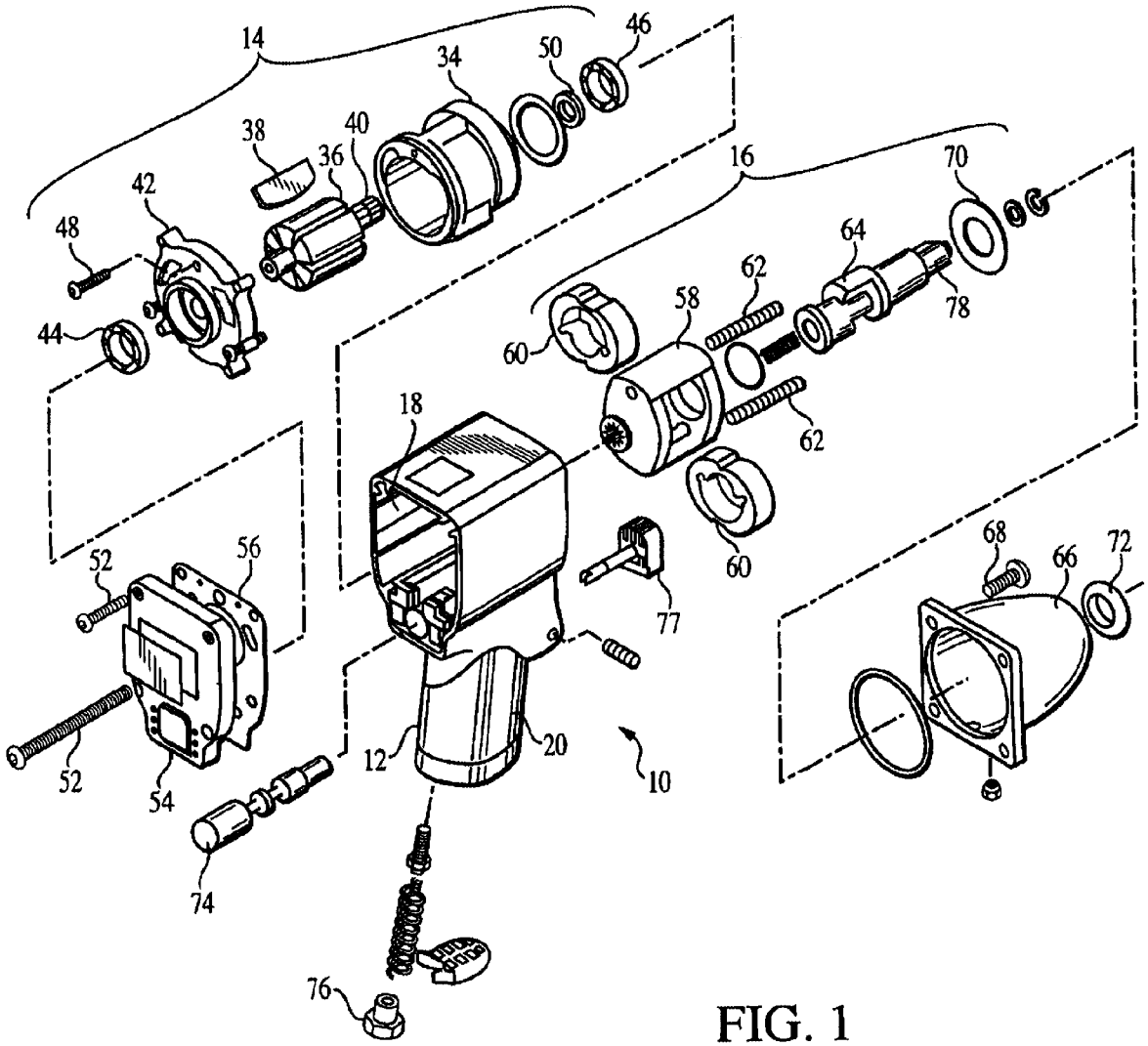
FIG. 1 is an exploded perspective view of the impact wrench of the invention.
Figure 2:
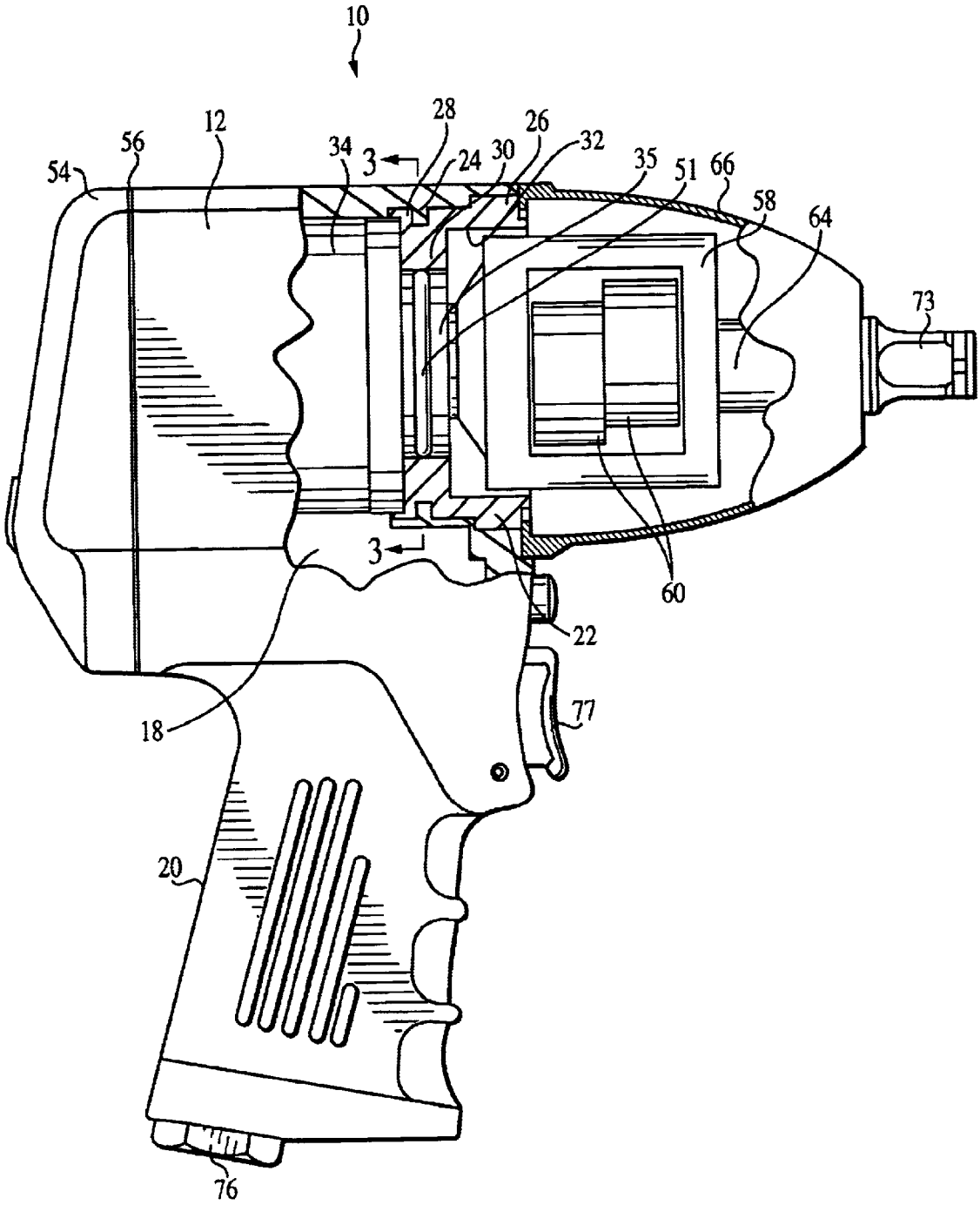
FIG. 2 is a partial longitudinal cross-sectional view of the impact wrench of the invention.
Figure 3:
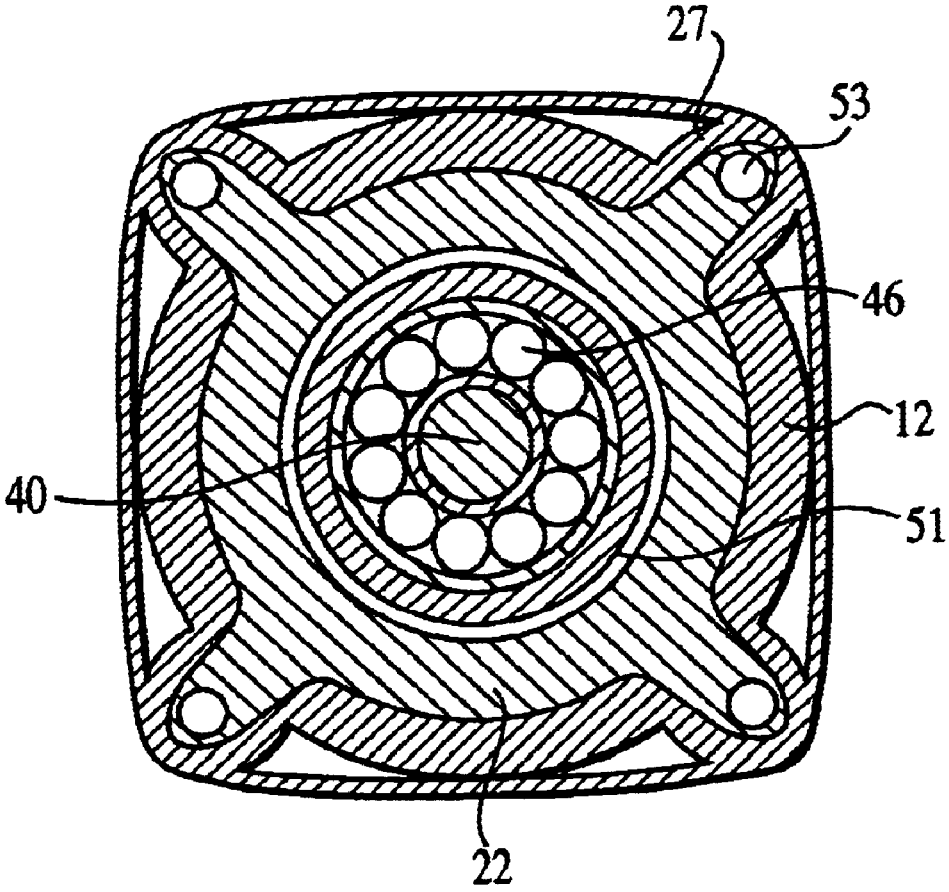
FIG. 3 is a transverse cross-sectional view taken along line 3—3 of FIG. 2.

Turning to the drawings, an impact wrench of the invention generally designated 10 comprises a housing 12, an air motor assembly 14, and an impact clutch assembly 16. The housing preferably comprises a motor area 18 for housing the air motor assembly, and a handle portion 20. A preformed insert 22 is held in the front portion of the air motor housing.

The housing 12 is molded plastic. A preferred plastic is nylon. More preferably, the housing is molded of a composite material, namely fiberglass filled or reinforced nylon. Methods of molding fiberglass filled nylon composite materials are well known in the art.

Insert 22 is preformed, that is, it is accurately fabricated prior to molding the housing. The preformed insert is fabricated in any manner, such as molding, and is preferably machined to close tolerances. The insert is made of a rigid material that will hold tolerances when subjected to heat and vibratory forces experienced in the use of power tools. Insert 22 is most preferably machined from aluminum, such as ADC 12 aluminum. The insert is securely held in housing 12, preferably by molding the insert into the housing. Although permanently molding the insert into the housing is preferred, other means may be used to fix the insert to the housing, such as by fasteners or welding. Insert 22 includes an outer annular groove 24, flange 26 and ears 27 to assist in permanently securing the insert to the housing in the molding process. The insert functions to prevent or minimize distortion of the housing during molding. The insert has a shallow rear cup portion 28, a central portion 30 of reduced diameter, and a front cup portion 32. The rear cup receives the air motor assembly, and the front cup receives the impact clutch assembly. The insert 22 accurately defines the axial centerline of the air motor assembly and clutch assembly.

Air motors for impact wrenches are well known in the art. The air motor assembly 14 comprises a cylinder 34, rotor 36 having a plurality (e.g., 6) blades 38 and shaft 40, rear plate 42, a rear bearing 44, and a front bearing 46. The air motor shaft 40 is supported by bearings 44, 46. Rear bearing 44 is held in the rear plate. Front bearing 46 is held within a reduced diameter extension 35 of the front or output end of cylinder 34. The rear plate is held to the cylinder by a plurality (e.g., 3) screws 48. The motor assembly also includes seals 50. Four screws 52 hold end cap 54 to housing 12 enclosing the motor area 18 of the housing. Preferably, screws 52 extend into threaded bores 53 within ears 27 of insert 22. A gasket 56 is sandwiched between the end cap 54 and housing 12.

The front of cylinder 34 is held in the rear cup portion 28 of the insert 22. Further, the reduced diameter extension 35 is pressed into the central portion 30 of the insert. The front bearing 46, which rotatably supports the motor shaft 40 is thereby held securely in the insert 22. Extension 35 includes an O-ring 51 to seal between cylinder 34 and insert 22. Accordingly, air is prevented from escaping into the clutch assembly housing. Likewise, oil in the clutch assembly housing cannot leak into the air motor.

Although a particular air motor assembly 14 has been shown and described, the present invention is not limited to this or any particular motor. Various means for supplying power to a power tool are well known in the art, including for example, air and electric motors, turbines and engines. The preformed insert and housing of the invention can be used in combination with any such motor, engine or other means for supplying power. For the purposes of this invention all such power supplying means shall be considered "motors."

Impact clutch assemblies are also well known in the art, see for example, U.S. Pat. Nos. 3,561,543 to Ulbing, 3,661,217 to Maurer, and 5,906,244 to Tompson et al, all of which are hereby incorporated by reference. Illustrated clutch assembly 16 comprises a twin cage 58, twin hammers 60, hammer pins 62 and anvil 64. A back end of cage 58 is received within the front cup 32 of the insert, and is operatively coupled with the motor shaft 40. The impact clutch assembly is housed within clutch housing 66 that is held to housing 12 with four screws 68. Preferably, screws 68 extend into the threaded bores 53 within ears 27 of insert 22. The impact clutch assembly further comprises washers 70 and seals 72.

Although a particular impact clutch assembly 16 has been shown and described, the present invention is not limited to this or any particular impact or clutch device. The insert and housing of the invention are potentially applicable various power transmitting means, all such means shall be referred to herein as "clutches."

The impact wrench 10 may desirably included a reversing valve assembly 74 to control direction of the tool motor, as disclosed in my co-pending application Ser. No. 09/907,026 filed Jul. 11, 2001, which is hereby incorporated by reference. The reversing valve, however, does not form a part of this invention.

In operation, a source of pressurized air is provided by an air compressor or the like and is connected by a hose (not shown) to inlet fitting 76 of the housing handle 20. The air passes through passages in the handle to a valve (not shown) that is actuated by trigger 77. When the trigger is depressed to operate the tool, air passes through reversing valve assembly 74 to the air motor 14. The air propels vanes 38 to rotate rotor shaft 40. Rotor shaft, supported by bearings 44, 46 transmits rotary mechanical power to the clutch assembly 16. The clutch assembly transmits power to the output shaft 78. As is well known in the art, when the tool is pressed against a nut or bolt, hammers 60 within cage 58 will be caused to repeatedly impact anvil 64 to provide a high torque impact drive to output shaft 78 to remove or tighten the nut or bolt.

While a preferred embodiment of the present invention has been shown and described, it is to be understood that it is merely the best mode for practicing the invention that the inventor foresees at the present time, and that various modifications and changes could be made thereto without departing from the scope and spirit of the invention as defined in the appended claims.

What is claimed is:

1. An improved power tool housing for a motor, the motor having an output shaft on one end of the motor, the improvement comprising, a molded plastic housing;

a preformed insert in said housing, said insert supporting the output shaft end of the motor; and a seal between the motor and said insert.

2. An improved power tool housing as in claim 1, wherein said preformed insert is molded into said plastic housing.

3. An improved power tool housing as in claim 1, wherein said plastic housing is molded from fiberglass filled nylon.

4. An improved power tool housing as in claim 1, wherein said preformed insert is metal.

5. An improved power tool housing as in claim 4, wherein said insert is machined.

6. An improved power tool housing as in claim 1, wherein said insert is machined aluminum.

7. An improved power tool housing as in claim 1, wherein the motor has an axis, said insert is centered on said axis, and said insert fixedly supports the motor on said axis.

8. A power tool comprising a housing comprised substantially of plastic, a metal insert molded into said housing, a motor in said housing, an output end of said motor having a bearing and a shaft rotationally supported by said bearing, said insert supporting the output end of said motor, and a clutch at least partly received in said insert and operatively coupled to said motor shaft, wherein said motor and said clutch have a common axis, said insert is between said motor and said clutch, and said insert fixedly secures said shaft on said common axis.

9. A power tool, comprising a housing comprised substantially of plastic, a metal insert molded into said housing, and a motor in said housing, an output end of said motor having a bearing and a shaft rotationally supported by said bearing, said insert supporting the output end of said motor.

10. A power tool as in claim 9, wherein said motor is an air motor.

11. A power tool as in claim 9, further comprising a clutch at least partly received in said insert and operatively coupled to said motor shaft.

12. A power tool as in claim 11, wherein said clutch is a rotary impact clutch.

13. A power tool as in claim 9, wherein said metal insert is directly and permanently secured to said plastic housing.

14. A power tool as in claim 11, wherein said motor is an air motor and said insert forms a seal between said air motor and said clutch.

15. A power tool as in claim 11, wherein said plastic housing is comprised of a fiberglass and nylon composite.

16. A power tool as in claim 11, wherein said insert is machined aluminum.

17. A method for making a power tool housing, comprising the steps of:

fabricating an insert from a rigid material;

positioning the insert in a housing mold to define an axis;

injecting the housing mold with plastic to form a housing and permanently secure the insert therein; and installing a motor into the insert, the motor having a shaft supported for rotation, about the axis.

18. A method as in claim 17, wherein the step of fabricating the insert comprises machining the insert from metal.

19. A method as in claim 17, wherein the plastic is a fiberglass and nylon composite.

20. A method as in claim 17, further comprising installing a clutch on the housing, and coupling the clutch to the motor shaft.

* * * * *